US006326531B1

(12) United States Patent
Bremner

(10) Patent No.: US 6,326,531 B1
(45) Date of Patent: Dec. 4, 2001

(54) INSTRUMENT CASE SUPPORT SYSTEM AND METHOD

(76) Inventor: Neil Bremner, 5665 W. Canyon Dr., Littleton, CO (US) 80128

( * ) Notice: Subject to any disclaimer, the term of this patent is extended or adjusted under 35 U.S.C. 154(b) by 0 days.

(21) Appl. No.: 09/629,960

(22) Filed: Aug. 1, 2000

(51) Int. Cl.[7] ..... G10D 3/00
(52) U.S. Cl. ..... 84/327; 84/421
(58) Field of Search ..... 84/327, 421, 291, 84/453; 248/166, 164

(56) References Cited

U.S. PATENT DOCUMENTS 4,869,147 * 9/1989 Hoshino ..... 84/421
5,054,357 * 10/1991 Pyle ..... 84/421
5,505,413 * 4/1996 Hennessey ..... 248/166
5,833,051 * 11/1998 Tiefenbrun et al. ..... 206/14
5,959,225 * 9/1999 Hsu ..... 84/327

* cited by examiner

*Primary Examiner*—Robert E. Nappi
*Assistant Examiner*—Kim Lockett
(74) *Attorney, Agent, or Firm*—Ramon L. Pizarro; Edwin H. Crabtree

(57) ABSTRACT

A system for supporting an instrument, such as a guitar in an accessible position. The system includes a stand for supporting and presenting the musical instrument while the musical instrument is held in a case adapted for carrying the musical instrument. The stand includes a base portion and a grasping portion. The grasping portion having a pair of opposing arms that extending above the base and is supported by the base. The arms are biased towards one another to allow the disclosed invention to grasp and support the case over the base portion.

17 Claims, 5 Drawing Sheets

INSTRUMENT CASE SUPPORT SYSTEM AND METHOD

BACKGROUND OF THE INVENTION (a) Field of the Invention

This invention generally relates to a device and method for supporting an instrument case in a manner that allows the case to present the instrument to a user. More particularly, but not by way of limitation, to a stand that includes four independently movable arms that extend from a central junction or hub. The arms are used to grasp the instrument case and to support the instrument case while presenting the musical instrument, in the case, to the musician.

(b) Discussion of Known Art

Musicians often rely on several musical instruments, each instrument serving as a backup for another instrument or simply providing a different sound. Thus, there is a need for a device that supports these instruments while not in use by the musician. Examples of devices that support guitars while not in use include U.S. Pat. No. 5,959,225 to Hsu, and U.S. Pat. No. 5,375,497 to Pirchio et al.

The approach taken by Hsu and Pirchio et al. serve as good examples of other known devices in that they have been adapted for accepting an instrument, such as a guitar, directly on the stand. This approach, however, exposes the guitar to the possibility of harm from falling objects, accidental collisions with passers by, or harm from falling due to the misplacement of the guitar on the stand. With this type of device the guitar is also exposed to dust and climatic conditions, such as humidity, that may harm the instrument.

To protect musical instruments, such as guitars, it is customary to provide a case that cradles and protects the instrument while stored or in transport. These cases typically include rigid sides and a padded internal compartment that will protect the instrument from accidents, such as falls, collisions, or spills. In order to play the instrument, the musician typically removes the instrument and places the unprotected instrument on a stand, such as the Hsu stand or the Pirichio et al. stand.

Other examples of guitar stands can be found in U.S. Pat. Nos. 5,957,417 to Yu, 5,836,552 to Yu, or 5,744,735 to Liao. These devices provide folding legs and a rest that accepts the back portion of the body of the guitar, allowing the guitar to be laid back against the rest. These devices suffer from the same limitations as the Hsu or Pirchio et al device in that they leave the guitar or musical instrument very exposed to external forces.

Other known stands for supporting musical instruments include devices such as the device described in U.S. Pat. No. 5,857,649 to Eason, or U.S. Pat. No. 5,358,204 to Terada. These mechanisms, however, have been designed for providing planar support as is required in supporting a keyboard or the like while playing.

A review of known devices reveals that there remains a need for a device or system that allows a person to provide support to a musical instrument, such as a guitar, and the protection of a guitar case. Additionally, there remains a need for a simple device that allows a user to store a guitar or other musical instrument in its case until ready to be played.

Still further, there remains a need for a device that can securely hold a musical instrument without placing excessive force directly on the instrument.

SUMMARY

It has been discovered that problems left unanswered by known art can be solved by providing a stand for and presenting a musical instrument while the musical instrument is held in a case adapted for carrying the musical instrument. A preferred example of the disclosed invention includes:

a base portion; and a grasping portion having a pair of opposing arms that extending above the base and is supported by the base. The arms are biased towards one another to allow the disclosed invention to grasp and support the case over the base portion.

According to a highly preferred embodiment of the invention the grasping portion includes at least one movable arm. The movable arm is urged against the other arm to squeeze or grasp a portion of the instrument case between the two arms. In one highly preferred example, an elastic or resilient member such as a spring or bungee chord provides the squeezing force.

In a highly preferred example, the invention includes a pair of movable arms pivotally supported from a central hub portion. Each of the arms includes a connector for accepting a section of bungee chord and a section adapted for contacting the case.

The arms are supported from a base portion that connects to the hub and provides a suitable foundation for supporting the invention over the floor. In a highly preferred example of the invention the base includes a pair of collapsing legs that are pivotally connected to the hub portion. It is important to note, that while this preferred embodiment includes a pair of pivoting legs, it is also contemplated that the disclosed invention may be practiced by providing a single leg that can accept a shelf that is similar to the shelf used with a highly preferred embodiment of the invention.

The disclosed invention will preferably incorporate at least one shelf portion that is attached to the base. The shelf, which may be formed from a single section of metal or other rigid material, provides support for the case and further enhances the security of the support provided by the invention.

Once the instrument case is mounted on the stand, access to the instrument is facilitated by including a removable, pivotable, arm or retainer that cooperated with the lid of the instrument case to hold the lid in an opened position. Thus, with the cased instrument on the stand, and with the lid held in an opened position, the user can remove or replace the instrument from the case as needed. Once the user is finished playing the instrument, he may then simply close the case and leave the instrument protected until needed again.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
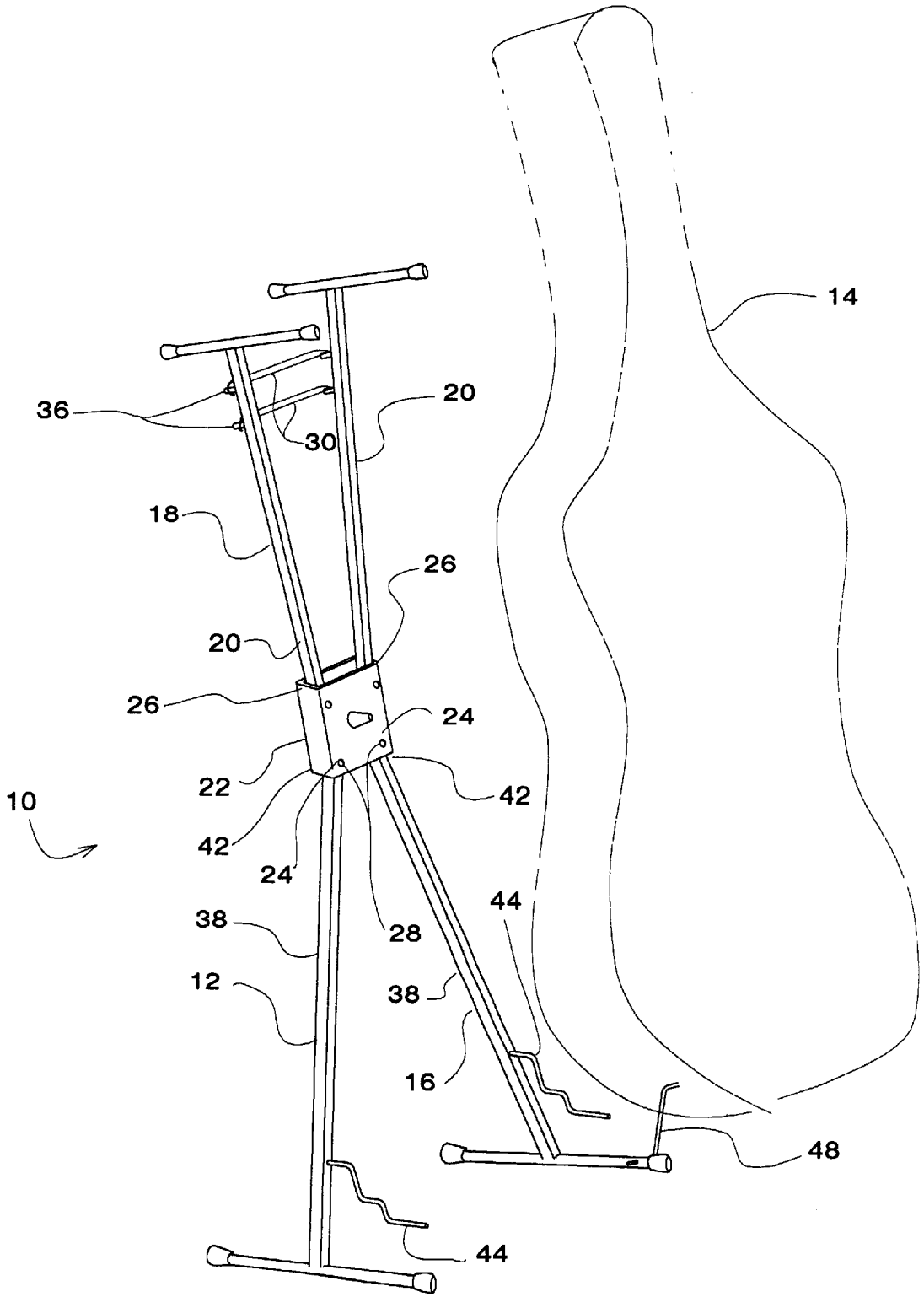
FIG. 1 is a perspective view of an embodiment of the invention, the view showing the outline of a guitar case before it is positioned on the invention.

Turning now to FIG. 1 where a system 10 for supporting an instrument has been illustrated. The system 10 includes a stand 12 that is used to supporting and presenting a musical instrument, such as a guitar, while the musical instrument is not being played. The stand 12 holds the instrument in its case 14, preferably a case of the type having generally rigid sides, which has been adapted for carrying the musical instrument when not in use.

As illustrated in FIG. 1, the stand 12 includes a base portion 16 and a grasping portion 18. The grasping portion 18 extends above the base 16 and is supported by the base 16. According to a highly preferred embodiment of the invention, the grasping portion will be used to grip the external portion or surface of the case 14. It is contemplated that one example of this grasping portion 18 will include at least one movable arm 20. Thus, while it is contemplated that the disclosed invention may incorporate one stationary arm and one movable arm 20 that moves towards the stationary arm, a preferred embodiment of the invention includes a pair of movable arms 20 that can move in an opposable manner, that is towards one another, in order to accept at least a portion of the enclosure or case 14. In the illustrated guitar case example, the arms 20 are of different lengths and are used to grasp the portion of the case 14 that holds the neck of the guitar.

Figure 2:
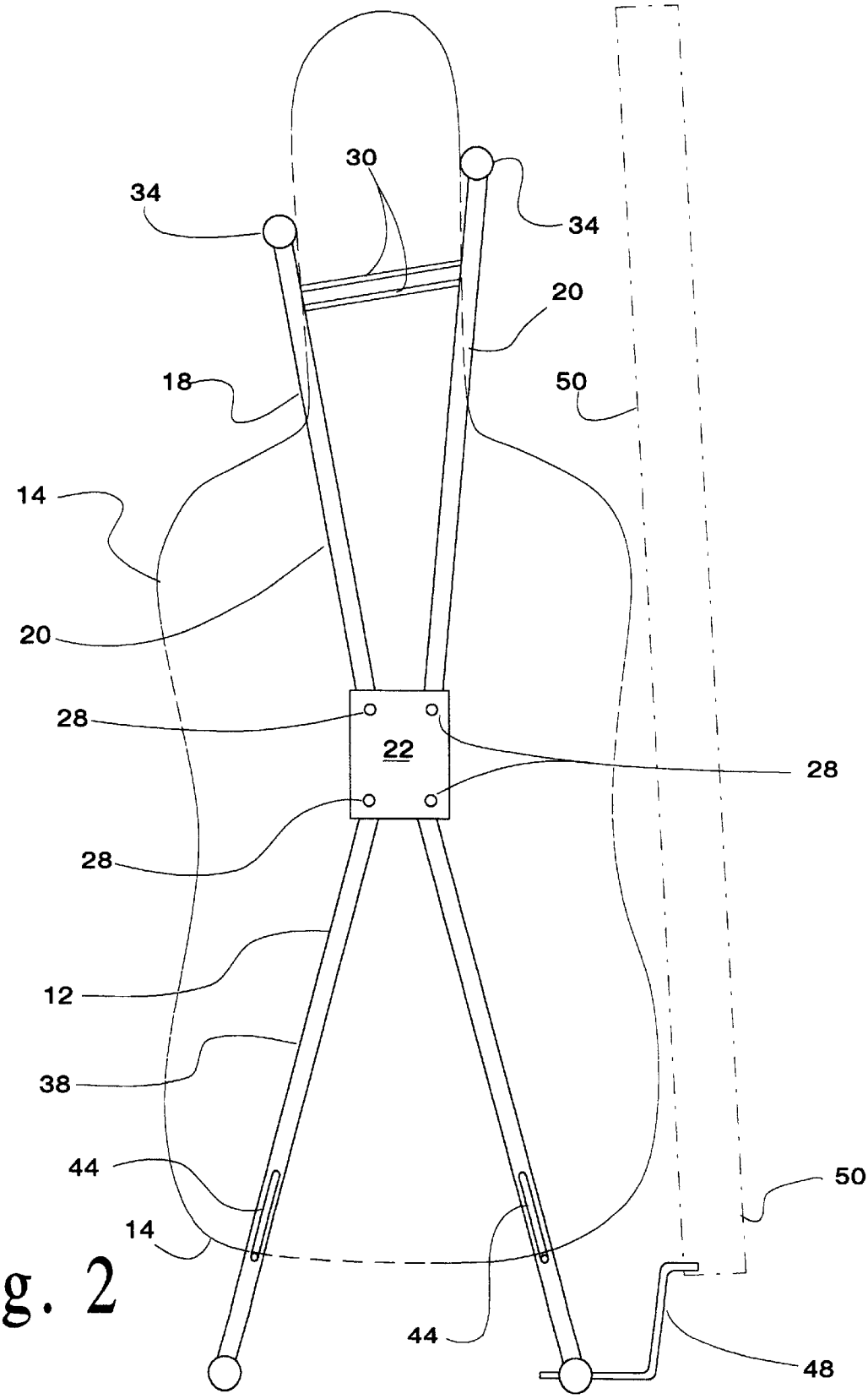
FIG. 2 is a view looking at a preferred embodiment of the invention while supporting a case with the lid of the case being held in an opened position.

Also illustrated in FIGS. 1 and 2, is that the pair of opposable arms 20 are pivotally connected to the base portion 16 through a hub 22. The hub 22 serves to provide pinned connections 24 to the arms 20 and to limit the travel of the arms 20 by providing stops 26 that limit the amount of pivoting movement achievable with the arms 20. In the illustrated example of the invention, the hub 22 is simply a section of rectangular tubing that supports pins 28 that are used to create the pinned connections 24. In this example, the function of the stops 26 is carried out by the sidewalls of the section of tubing. The sidewalls projecting into the travel path of the pivoting arms 20.

Also illustrated in the enclosed figures, is that at least one elastic member 30, which may be formed by a metal spring, a resilient component or the like, is used to bias the arms 20 towards one another. Thus, as shown on FIG. 4, the arms 20 will pivot in the direction of arrows 32. The elastic member 30 is used to bias the arms 20 in the direction of the arrows 32, towards one another, to allow the arms 20 to grasp and retain the case 14 between the arms 20.

Figure 3:
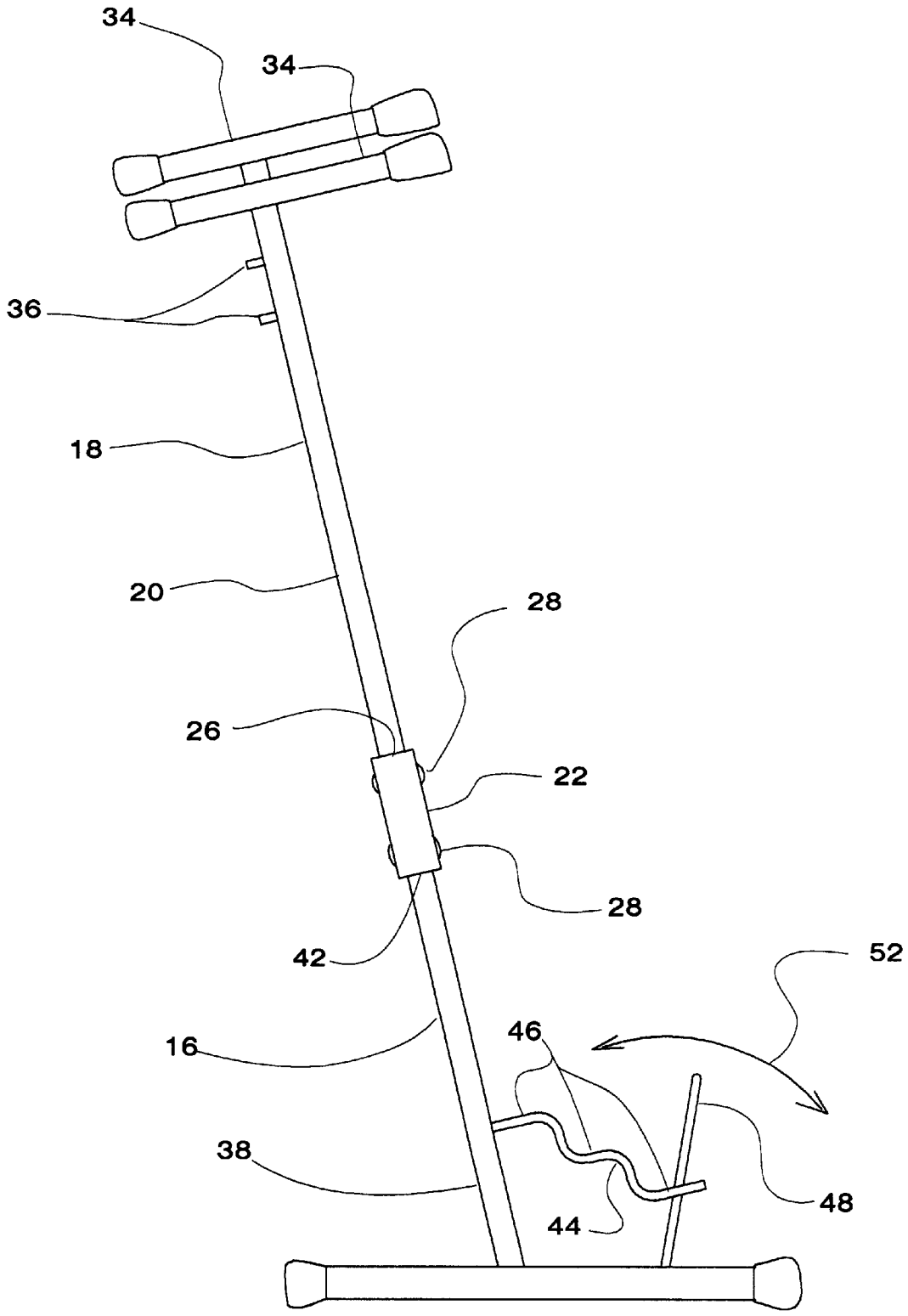
FIG. 3 is a side view of a preferred embodiment of the invention, and illustrates the generally angled, reclined support provided by a preferred embodiment of the invention.

Also illustrated in FIGS. 1, 2, and 3, is that the arms 20 will preferably terminate in contact members 34 that project from the arms 20. In a preferred embodiment of the invention, the elastic members 30 will engage the arms 20 through lugs 36 that protrude from the arms 20. Thus, it is contemplated that an elastic member 30, such as a bungee chord, may be attached to the lugs 36 to bias the arms 20 towards one another to grip a guitar case as shown on FIG. 2.

Figure 4:
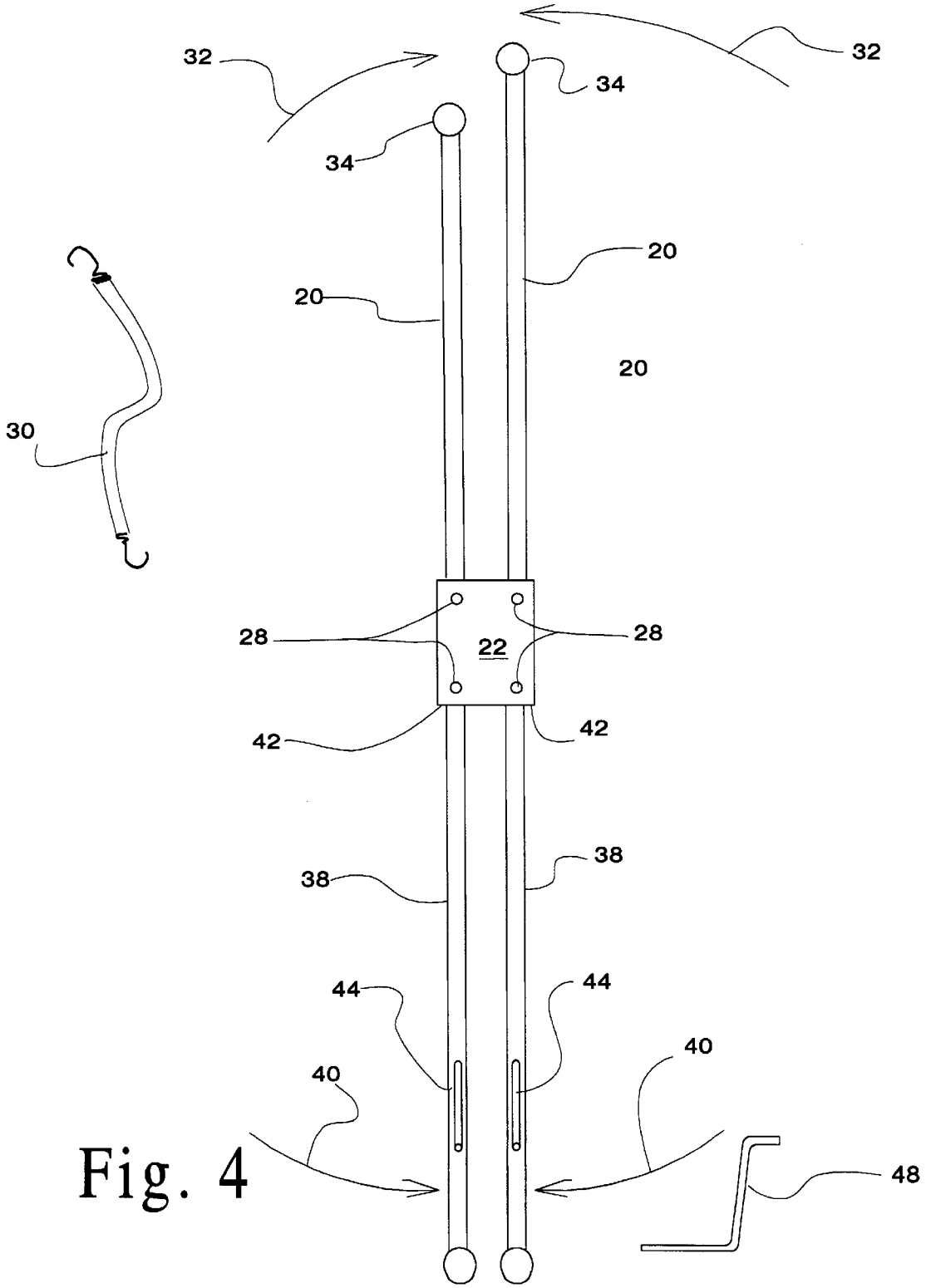
FIG. 4 illustrates a preferred embodiment of the invention in a collapsed position, with a lid retainer removed from the base.

Turning now to FIGS. 3 and 4 it will be understood that the base portion 16 will preferably include at least two collapsing legs 38. The legs 38 will be pivotally connected to the hub 22, and will be collapsible in the direction of arrows 40, illustrated in FIG. 4. The hub 22 will provide stops 42 that will limit the angle between the legs 38, and thus ensure that the legs 38 will not expand or open to the point to where the stand 12 becomes unstable or collapses.

Also illustrated on FIG. 3 is the use of at least one shelf member 44 that extends from the leg 38, and most preferably a shelf member 44 extends from each of the legs 38. The illustrated shelf member 44 includes several step surfaces 46 that are used to accommodate different sizes or shapes of instrument cases.

Also illustrated in FIGS. 2 and 3 is the use of a retainer 48 adapted holding the lid 50 of the enclosure or case 14 in an open position. The retainer 48 is removable, and can pivot in the direction of arrow 52 to accommodate various configurations of lids 50. When the case 14 is in this open position, the musician will have access to the musical instrument as desired. Additionally, when the instrument is not in use, the case 14 provide more protection to the instrument than what is provided by simple stands found in known art.

Still further, it will be understood that the legs 38 may be telescoping, or a single fixed or telescoping leg may be used on the base. Additionally, it is contemplated that the arms 20 may cooperate with an indexing mechanism that allows positioning of a spring or other resilient component on one of the arms 20, and produce a biasing of the arms towards one another. This may be accomplished by positioning a spring extending between the arms, or with the spring being concealed within the hub 22. Additionally, a single spring within the hub may be used to bias one of the arms towards the other arm, while providing a rigid link between the two arms to cause the arms to move towards one another.

Figure 5:
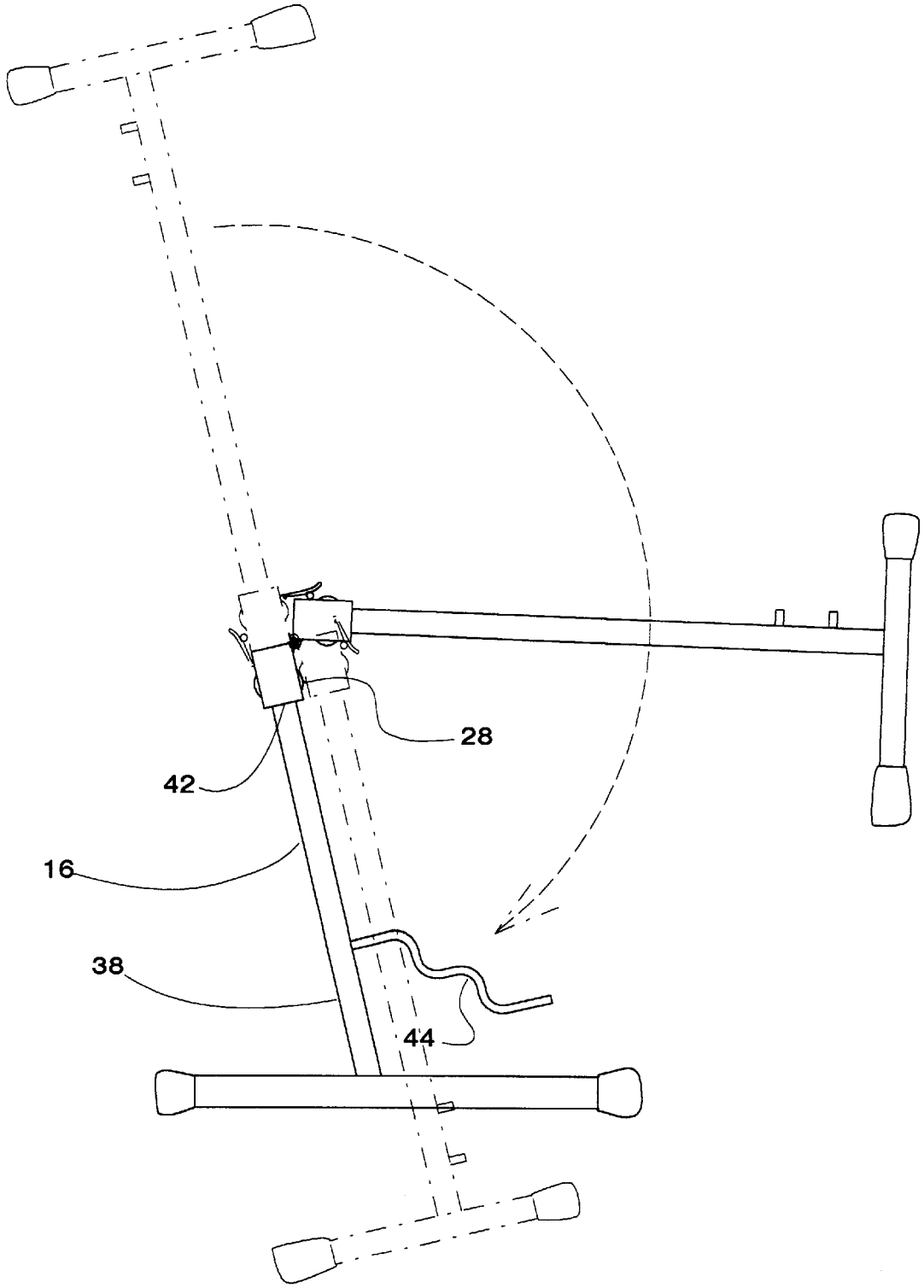
FIG. 5 illustrates the use of a hub that incorporates a hinge and a latch mechanism that allows folding or further collapsing of the stand for storage.

Turning now to FIG. 5, it will be understood that it is further contemplated that the disclosed invention may incorporate a hinge 100 and latch 102 mechanism that allows the hub 22 to fold and allow nesting of the arms 20 about or between the base portion 16. It is important to note that while the illustration shows folding of the hub 22 in one direction, it is contemplated that the position of the hinge 100 and latch 102 may be changed to allow folding in a different direction. Also, it is contemplated that this function may be carried out by adding hinges to the arms 20 or the base portion 16.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A stand for supporting and presenting a musical instrument while the musical instrument is held in a case adapted for carrying the musical instrument, the stand comprising:

a base portion; and a grasping portion, the grasping portion extending above the base and is supported by the base, the grasping portion having a pair of arms, said pair of opposable arms have been adapted for accepting a resilient biasing member, so that the arms are biased against the enclosure by the resilient biasing member at least a portion of the case while supporting the case over the base, so that the instrument is supported and presented while held in the case while supported by the stand.

2. A stand according to claim 1 wherein said pair of opposable arms are pivotally connected to said base portion.

3. A stand according to claim 1 wherein said mechanism for biasing at least one arm towards the other arm comprises a pair of opposable arms that are independently pivotable towards one another, so that the arms are biased against the case by the resilient biasing member.

4. A stand according to claim 1 wherein said base portion comprises at least two collapsing legs.

5. A stand according to claim 1 wherein said movable arms of said grasping portion include at least one arm that is biased towards the other arm by a spring.

6. A stand according to claim 1 wherein said mechanism for biasing at least one arm towards the other arm includes an elastic biasing member for urging the arms against the case when the case is positioned between the arms.

7. A stand according to claim 4 wherein at least one of said legs further comprises at least one shelf member extending from the leg.

8. A stand according to claim 1 and further comprising a hub portion the hub portion being between and below the opposable arms and the base.

9. A stand for supporting and presenting a musical instrument while the musical instrument is held in a case adapted for carrying the musical instrument, the stand comprising:

a collapsible base portion; and a grasping portion, the grasping portion extending above the base and is supported by the base, the grasping portion having a pair of movable arms adapted for accepting and grasping at least a portion of the case while supporting the case over the base and a resilient biasing member for pulling the arms towards one another, the arms being movable towards one another, so that the instrument is supported and presented while held in the case while supported by the stand.

10. A stand according to claim 9 wherein said base portion comprises at least two pivoting legs connected to a hub portion, the hub portion supporting said arms over the pivoting legs.

11. A stand according to claim 10 wherein at least one of said legs further comprises at least one shelf member extending from the leg.

12. A method for supporting and presenting a musical instrument, the method comprising:

providing a generally rigid case adapted for holding the instrument;

providing a stand, the stand comprising:

a base portion; and a grasping portion, the grasping portion comprising a pair of opposable arms being adapted for accepting part of the case, the grasping portion further having a resilient component for urging the opposable arms towards one another; and placing the musical instrument in the case while supporting the case on the stand, and urging the opposable arms towards one another, squeezing the case between the opposable arms, so that a user supports and obtains access to the instrument while the instrument is held in the case.

13. A method according to claim 12 wherein said base portion comprises at least two collapsing legs.

14. A method according to claim 12 wherein said enclosure comprises a hinged lid, and said base further comprises a retainer adapted holding the lid of the enclosure in an open position.

15. A method according to claim 13 wherein said grasping portion is mounted over said base portion.

16. A method according to claim 15 wherein said arms accept an elastic biasing member for urging the arms against the enclosure.

17. A method according to claim 16 wherein at least one of said legs further comprises at least one shelf member extending from one of the legs.

* * * * *